United States Patent [19]

Fisher

[11] Patent Number: 4,493,193

[45] Date of Patent: Jan. 15, 1985

[54] REVERSIBLE CYCLE HEATING AND COOLING SYSTEM

[75] Inventor: Ralph H. Fisher, Newport News, Va.

[73] Assignees: Rutherford C. Lake, Jr.; John E. Duberg, both of Newport News, Va. ; part interest to each

[21] Appl. No.: 542,375

[22] Filed: Oct. 17, 1983

Related U.S. Application Data

[63] Continuation-in-part of Ser. No. 355,123, Mar. 5, 1982, Pat. No. 4,409,796.

[51] Int. Cl.[3] ..... F25B 13/00

[52] U.S. Cl. ..... 62/160; 62/235.1; 62/238.6; 62/238.7; 62/524.1; 62/324.4

[58] Field of Search ..... 62/160, 324.1, 324.4, 62/238.6, 238.7, 235.1; 237/2 B

[56] References Cited

U.S. PATENT DOCUMENTS

| | | | |
|---|---|---|---|
| 3,563,304 | 2/1971 | McGrath | 62/238.6 X |
| 3,918,268 | 11/1975 | Nussbaum | 62/160 X |
| 4,165,037 | 8/1979 | McCarson | 62/238.6 X |
| 4,173,865 | 11/1979 | Sawyer | 62/160 X |
| 4,191,023 | 3/1980 | Sisk et al. | 62/324.1 X |
| 4,256,475 | 3/1981 | Schafer | 62/238.7 X |
| 4,257,239 | 3/1981 | Partin et al. | 62/238.7 |
| 4,270,518 | 6/1981 | Bourne | 62/238.7 X |

*Primary Examiner*—Lloyd L. King

*Attorney, Agent, or Firm*—Sixbey, Friedman & Leedom

[57] ABSTRACT

A reversible mode heating and cooling system comprises a conventional reversible heat pump unit having a compressor, a reversible valve, an indoor heat exchanger in heat exchange relationship with indoor ambient air, refrigerant expansion means and an outdoor heat exchanger in heat exchange relationship with outdoor ambient air, and operatively associated therewith, an auxiliary heat exchanger in heat exchange relationship with a heat exchange fluid for enhancing the capacity and efficiency of the system to evaporate refrigerant during the heating mode and to condense refrigerant during the cooling mode. The auxiliary heat exchanger is arranged for selective parallel or simultaneous parallel and series flow of refrigerant through the auxiliary heat exchanger and the outdoor heat exchanger to enhance the heating efficiency of the system at very low outdoor ambient temperatures. A temperature and/or pressure sensing and flow control subsystem is operatively associated with the heating and cooling system to sense system or ambient parameters and to operate fluid flow control valves to most efficiently and effectively direct refrigerant flow to the outdoor and/or auxiliary heat exchangers. A frost preventative or defrost system for the auxiliary heat exchange coil is provided which includes a reclamation heat exchanger in the compressor discharge line for transferring heat from the refrigerant to the heat exchange fluid enroute to the auxiliary coil.

9 Claims, 5 Drawing Figures

REVERSIBLE CYCLE HEATING AND COOLING SYSTEM

CROSS-REFERENCE TO RELATED APPLICATIONS

This application is a continuation-in-part of U.S. application Ser. No. 355,123, filed Mar. 5, 1982, now U.S. Pat. No. 4,409,796.

FIELD OF THE INVENTION

The present invention relates to heating and cooling systems and, more particularly, to such systems which include a heat pump unit operatively associated with auxiliary heat exchange means.

DESCRIPTION OF THE PRIOR ART

A heat pump is essentially a device for pumping an appropriate refrigerant fluid around a closed circuit for the purpose of heating or cooling a generally indoor space. The conventional elements of a heat pump include a compressor, an expansion valve, an indoor heat exchange coil, an outdoor heat exchange coil, a refrigerant fluid, suitable refrigerant piping, and a refrigerant flow reversing valve. The heat pump has two sides—a low pressure side and a high pressure side. This pressure difference is caused by the compressor and expansion valve which also separates the two sides. One heat exchange coil is located on one pressure side while the other heat exchange coil is on the other side. Generally one heat exchange coil is located inside an enclosure to be heated or cooled and the other coil is located outdoors. The reversing valve is used to reverse the direction of the flow of refrigerant through the heat pump which has the effect of reversing the pressure sides. Thus, at one time the inside coil can be on the low pressure side while at another time the outside coil can be on the low pressure side. Heat is absorbed by the refrigerant in the coil on the low pressure side and given up by the refrigerant in the coil on the high pressure side. Thus, a heat pump transfers heat between the indoor and outdoor coil depending on the position of the reversing valve.

When used as a refrigerating or an air conditioning device, the inside heat exchanger is located on the low pressure side and within the space to be cooled. Heat is absorbed by the liquid refrigerant evaporating within the inside heat exchanger and is rejected by the vaporized refrigerant condensing in the outdoor heat exchanger. Thus, during hot weather, heat is moved from indoors to outdoors to cool the enclosure. When used as a heating device, the inside heat exchanger is located on the high pressure side and within the space to be heated. Heat is absorbed by the liquid refrigerant evaporating within the outdoor heat exchanger and is rejected by the vaporized refrigerant condensing in the inside heat exchanger. Thus, during cold weather, heat is moved from outdoors to indoors to warm the enclosure.

One noteworthy shortcoming of a conventional heat pump is its inability to transfer sufficient heat from outdoors to indoors to warm the enclosure during very cold weather when outdoor ambient temperatures are very low. As a practical matter, when the outdoor ambient temperature falls below about 35°-45° F. there is a notable reduction in the capacity of the outdoor heat exchange coil to provide satisfactory heating. This is, in large part, due to the decreased heat which can practically be absorbed by the coil at very low outdoor ambient air temperatures. When the outdoor ambient temperature drops and evaporation is accomplished in an outdoor air heat exchanger of fixed geometry, the result is a drop in evaporation temperature and pressure. This causes a substantial reduction in the density of the refrigerant vapor. The compressor, therefore, can circulate only a substantially reduced mass of refrigerant which accounts, in part, for the substantially reduced heating capacity of the system. Moreover, at the reduced refrigerant pressures, there is a marked loss of volumetric efficiency of the compressor both in terms of quantity of heat contributed by the compressor and in relative heat contribution to the refrigerant fluid.

The practical solution to this requirement for additional heat for the indoor space to be heated has been to furnish supplemental heating, usually in the form of relatively expensive electrical resistance heating or, alternatively, fossil fuel heating. However, with decreasing availability of fossil fuels, increasing energy costs and demanding space and health considerations, neither of these solutions is very appealing or practical any longer. Instead, supplemental heat for heating the indoor space is now frequently derived from a third heat exchange coil disposed in heat exchange relationship with a stable temperature heat source, such as ground water or heat storage facilities which are thermally charged from any of a variety of thermal sources, such as solar collectors, electrical resistance heaters operated during off peak, low demand hours or even from the heat pump unit itself operated during periods of relatively high ambient air temperatures. Such an arrangement is illustrated, for example, in U.S. Pat. No. 4,165,037 which discloses an auxiliary heat exchanger operatively associated and in parallel with respect to refrigerant flow with the outdoor heat exchanger of a heat pump unit. During periods of severely low outdoor ambient temperature, when the efficiency and capacity of the outdoor heat exchanger is reduced and impaired, refrigerant flow is diverted to the auxiliary heat exchanger which derives its thermal energy from a water storage source heated by a solar collector unit. A somewhat similar arrangement is disclosed in U.S. Pat. No. 4,256,475 which shows a solar heated water storage unit for supplying water to the coil of an auxiliary water heat exchanger arranged in parallel with the outdoor heat exchanger of a heat pump unit. When the heat pump unit, due to low outdoor ambient temperature, cannot transfer sufficient heat from the outdoor air to warm the space to be heated, water from the storage unit is circulated to the coil of the auxiliary water heat exchanger to carry heat from the solar heated water storage unit to the refrigerant and, eventually, via the indoor heat exchanger to the space to be heated. Also of interest is U.S. Pat. No. 3,563,304 which discloses an auxiliary heat exchange coil in heat exchange relationship with a pool of water arranged in series with the conventional outdoor coil of a heat pump unit. During the heating mode of heat pump operation a refrigerant first absorbs heat from the outdoor ambient air in the outdoor heat exchange coil and then absorbs heat from the pool of water in the auxiliary heat exchange coil. However, when outdoor ambient air temperature is extremely low and it is desired to remove the conventional outdoor coil from operation, by virtue of the series arrangement refrigerant will still pass through the outdoor coil and heat will be lost therein.

A problem associated with the use of auxiliary or supplemental heat exchange units which transfer the thermal energy of water to the refrigerant in the heating mode is that under conditions of very low outdoor ambient temperature (e.g., less than about 20° C.) insufficient thermal energy is transferred to the refrigerant in the outdoor heat exchange coil. The result, due to the relatively small amount of water flowing in the auxiliary or supplemental heat exchange coil, is that the refrigerant causes the moisture in the air to freeze onto the coils, precluding heat transfer therethrough and necessitating a shut down of the entire system to de-ice the frozen coil, for example by a hot gas defrost cycle.

SUMMARY OF THE INVENTION

It is, therefore an object of the present invention to provide an extremely simple, practical and efficient heating and cooling system which includes thermally responsive flow control means to optimize system capacity and efficiency during periods of extremely low and extremely high ambient temperature conditions.

It is another object of the invention to provide a heating and cooling system including a heat pump unit wherein the evaporating and/or condensing capacity of the outdoor heat exchange coil thereof is supplemented by an auxiliary heat exchange coil connected in series-parallel therewith.

It is still another object o the invention to provide a heating and cooling system including a heat pump unit wherein the refrigerant flow relationship between the outdoor coil of the heat pump and an auxiliary heat exchange coil utilized in operative association therewith is variable between parallel and series-parallel by thermally responsive flow control means.

It is a further object of the invention to provide a heating and cooling system including an auxiliary heat exchange coil having a flow of water therethrough during the heating mode of operation for furnishing thermal energy for evaporating the refrigerant, and further including auxiliary coil frost preventative or defrost means comprising a thermal energy reclamation heat exchanger for transferring heat from relatively hot refrigerant discharging the compressor to relatively cold water flowing through the reclamation heat exchanger to the auxiliary coil.

Other objects and advantages will become apparent from the following description and appended claims considered together with the accompanying drawings.

Briefly stated, in accordance with the aforesaid objects, the present invention provides a reversible mode heating and cooling system comprising a compressor, a reversible valve for selectively providing heating and cooling from the system by flow path selection, an indoor heat exchanger in heat exchange relationship with indoor ambient air for condensing refrigerant during the heating mode and evaporating refrigerant during the cooling mode, refrigerant expansion means for throttling the refrigerant, an outdoor heat exchanger in heat exchange relationship with outdoor ambient air for evaporating refrigerant during the heating mode and condensing refrigerant during the cooling mode, and an auxiliary heat exchanger in heat exchange relationship with a heat exchange fluid for enhancing the capacity and efficiency of the system to evaporate refrigerant during the heating mode. The auxiliary heat exchanger is desirably arranged for selective parallel or simultaneous parallel and series flow of refrigerant through the auxiliary heat exchanger and the outdoor heat exchanger to enhance the heating efficiency of the system at very low outdoor ambient temperatures and the cooling efficiency of the system at very high outdoor ambient temperatures. A temperature and/or pressure sensing and flow control subsystem is operatively associated with the heating and cooling system to sense system or ambient parameters and to operate fluid flow control valves to most efficiently and effectively direct refrigerant flow to the outdoor and/or auxiliary heat exchangers and to provide and control heat transfer fluid flow to the auxiliary heat exchanger when needed. Frost preventative and/or defrost means are associated with the auxiliary heat exchanger coil for providing heated water thereto by passing relatively hot compressor discharge refrigerant in heat exchange relationship with relatively cool water.

DESCRIPTION OF THE PREFERRED EMBODIMENTS

Figure 1:
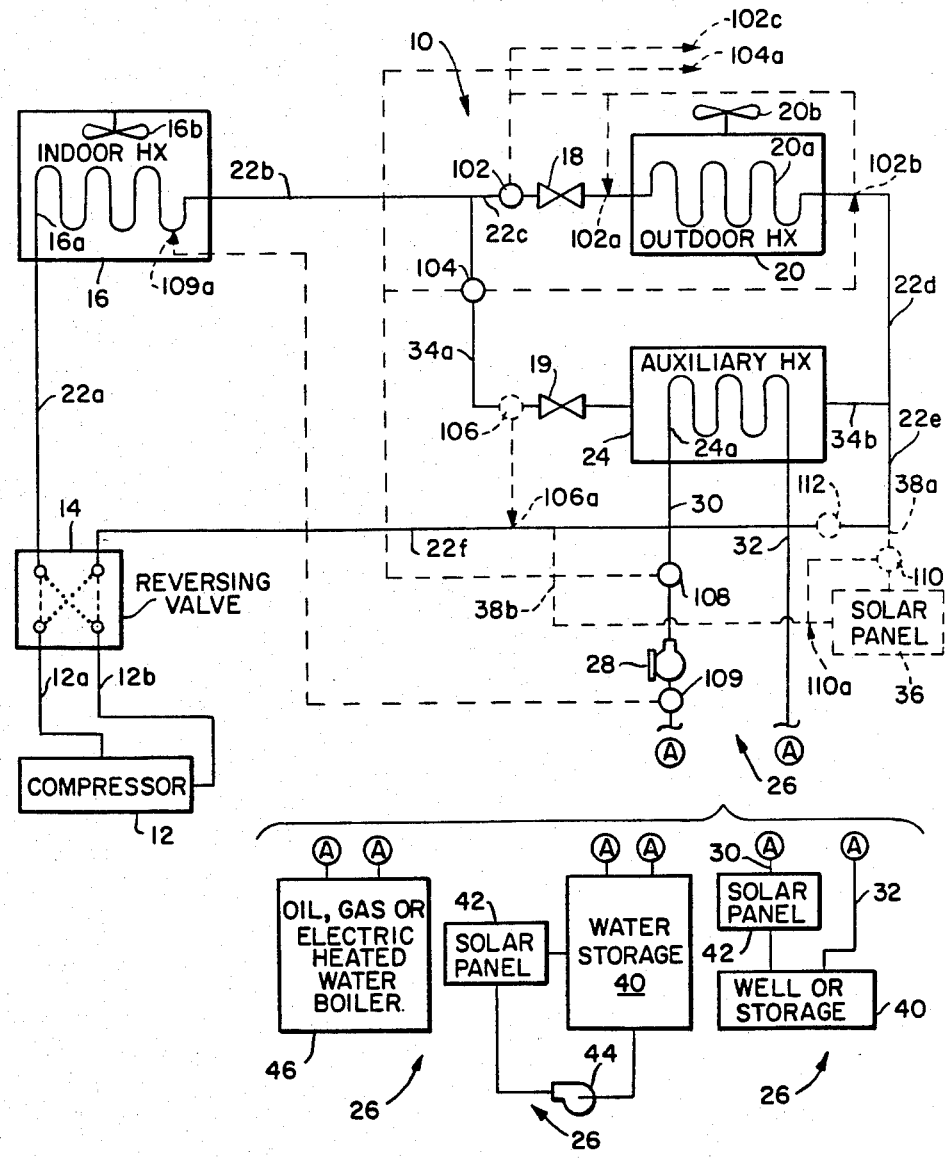
FIG. 1 is a schematic view illustrating a heat pump unit provided with an auxiliary heat exchange unit and a number of exemplary thermal sources and storage facilities therefor.

Referring to the drawings there is illustrated a conventional heat pump system including auxiliary heat exchanger means to enhance the heating and cooling efficiency of the system, particularly during the heating mode at very low ambient temperatures and during the cooling mode at very high ambient temperatures. As is well known, a conventional heat pump system may be reversible to switch between the heating and cooling modes. For descriptive simplicity the elements of the present heat pump system will be described and explained in terms of the heating mode, it being understood that the system may be reversed in conventional manner for the cooling mode.

The basic heat pump system 10 consists essentially of a compressor 12, a reversing valve 14, an indoor heat exchanger 16, an expansion valve 18 and an outdoor heat exchanger 20. Depending upon the position of reversing valve 14, the system is connected to selectively provide heating or cooling. As shown in FIG. 1, reversing valve 14 is in position to provide heating from indoor heat exchanger 16 which is normally located within or in air flow communication with the space to be heated (or cooled). In its essential aspects, indoor heat exchanger 16 includes a heat exchange coil **16*a* and a fan member 16*b*. Heated vaporized refrigerant from compressor 12 passes through compressor discharge conduit 12*a*, reversing valve 14 positioned as shown in dashed lines to provide heating from the system, through refrigerant conduit 22***a* and into and through heat exchange coil 16*a*. The fan member 16*b* blows air over the coil 16*a*, operating as a condenser coil, and heat is absorbed by the air from the heated refrigerant in the coil. The resulting heated air may then be distributed through the space to be heated in a conventional manner, such as via a conventional air duct system.

The heated refrigerant in coil 16*a* is condensed by the flow of air thereover and the resulting condensed refrigerant exiting coil 16*a* is directed through refrigerant conduit 22*b*, expansion valve 18 and refrigerant conduit 22*c* to outdoor heat exchanger 20. The expansion valve 18 throttles the condensed refrigerant to reduce the pressure and the saturation temperature of the liquid in order to enhance evaporative heat transfer to the refrigerant liquid in outdoor heat exchanger 20.

Outdoor heat exchanger 20 is located in heat exchange relationship with the outdoor ambient air and operates to transfer heat from the outdoor ambient air to the liquid refrigerant. For this purpose, outdoor heat exchanger 20 consists essentially of a heat exchange coil 20*a* and a fan member 20*b*. Relatively cool liquid refrigerant passes into and through coil 20*a*. Fan member 20*b* blows outdoor ambient air over coil 20*a*, operating as an evaporator coil, and heat is absorbed from the ambient air by the liquid refrigerant as the refrigerant vaporizes. The vaporized refrigerant returns to compressor 12 via refrigerant conduits 22*d*, 22*e*, 22*f*, reversing valve 14 positioned as shown in dashed lines to provide heating from the system and compressor suction conduit 12*b*. In compressor 12 the vaporized refrigerant is further heated by the work of compression and pump work and the heated vaporized refrigerant is in condition to initiate another cycle of the heating mode for the heat pump system.

The heat pump system hereinbefore described is conventional in all respects and operates without difficulty to heat the space to be heated as long as the outdoor ambient temperature remains sufficiently high, generally above about 35°–45° F. In such a case enough heat can be transferred to the refrigerant in outdoor heat exchange coil 20*a* that such heat, together with the heat added to the refrigerant in compressor 12, is sufficient, when transferred to the air blown over indoor heat exchange coil 16*a*, to heat the space to be heated. When the outdoor ambient temperature drops below about 35°–45° F., there occurs an observable diminution in available heat for space heating, as has previously been discussed, and a supplemental heat source becomes necessary. In the heat pump system 10 illustrated in FIG. 1, an auxiliary heat exchanger 24 is provided in parallel with outdoor heat exchanger 20 to increase the capacity of the system to absorb heat for vaporizing the refrigerant. Auxiliary heat exchanger 24 consists of a heat exchange means, such as coil 24*a*, through which a heat exchange fluid carrying thermal energy from a source 26 to be described more fully hereinafter, may be circulated via pump 28 and heat exchange fluid feed and discharge lines 30,32. Liquid refrigerant from conduit 22*c* may be diverted through refrigerant auxiliary bypass conduit 34*a* and bypass expansion valve 19 to flow through auxiliary heat exchanger 24 in heat exchange relationship with coil 24*a*, wherein the refrigerant absorbs heat and vaporizes, and is then returned via auxiliary bypass conduit 34*b* to refrigerant conduit 22*e*.

Thermal source 26 for supplying heat to the coil 24*a* of auxiliary heat exchanger 24 may be as simple or sophisticated as energy and natural resource availability and/or environmental conditions allow. Thus, a stable ground water source, such as a well, may be adequate by itself to provide the supplemental thermal requirements of the system. In such a case, relatively warm well water would be drawn via pump 28 and feed line 30 into coil 24*a* and relatively cool well water would be discharged from coil 24*a* via discharge line 32. In another system, either a well or insulated water storage tank 40 would serve as the heat exchange fluid source and thermal energy would be furnished to the fluid from a solar collector panel 42 mounted in a suitable location for receiving and absorbing solar radiation from the sun. Thus, pump 28 would pass water from well or storage tank 40 in heat exchange relationship with the solar energy absorbing element of collector panel 42 to absorb heat therefrom and then circulate the heated water via feed line 30 through coil 24*a*. In the coil heat would be given up to the refrigerant and the resulting relatively cool water would be returned via discharge line 32 to storage tank 40. In a slight variation of this system, water storage tank 40 and solar collector panel 42 are in a separate closed loop which includes circulating pump 44. Pump 44 circulates water from storage tank 40 through solar panel 42 to heat the fluid and then back to storage tank 40 to maintain an adequate supply of relatively warm water at a predetermined suitable temperature available at all times. When auxiliary heat exchanger 24 is placed in service, the relatively warm water is drawn by pump 28 directly from tank 40 and passed through coil 24*a* wherein the water is cooled as the refrigerant is vaporized and the resulting relatively cool water is returned to tank 40 via discharge line 32. Another simple and suitable thermal source 26 for auxiliary heat exchanger 24 is a water boiler unit 46 to which energy is supplied for heating the water therein to a suitable temperature from any variety of conventional energy sources, such as electrical resistance heating, combustion of oil, natural gas or other suitable fuel and the like.

The operation of the system 10 illustrated in FIG. 1 to provide efficient heating utilizing temperature sensing and flow control subsystem 100 to direct refrigerant flow to the appropriate heat exchange alternatives will be better understood from the following description. In normal operation of system 10 in the heating mode under conditions wherein outdoor ambient air is above about 35°–45° F., solenoid valve 102 at the inlet to outdoor heat exchanger 20 is open. Solenoid valve 104 in auxiliary bypass conduit 34*a* is closed and solenoid valve 108 in auxiliary coil heat exchange fluid feed line 30 is also closed. Heated vaporized refrigerant is pumped from compressor 12 via compressor discharge conduit 12*a*, reversing valve 14 and refrigerant conduit 22*a* to indoor heat exchanger coil 16*a* wherein the vaporized refrigerant condenses as it gives up its heat to ambient indoor air blown over coil 16*a* by fan member 16*b*. The heated air is used to heat the space to be heated. The condensed refrigerant passes via conduit 22*b* through expansion valve 18, conduit 22*c* and valve 102 into coil 20*a* of outdoor heat exchanger 20. Ambient outdoor air is blown by fan 20*b* over coil 20*a* to transfer heat from the ambient outdoor air to the liquid refrigerant in coil 20*a*, thereby vaporizing the refrigerant in the coil. The vaporized refrigerant exiting coil 20*a* returns via conduits 22*d*, 22*e* and 22*f* and reversing valve 14 to suction conduit 12*b* of compressor 12. In this manner the space to be heated is adequately heated by the heated air produced in indoor heat exchanger 16.

As the outdoor ambient temperature drops below about 35°–45° F., the ability of the outdoor heat exchanger 20 to transfer heat to the refrigerant decreases and the temperature of the vapor exiting coil 20*a* and eventually reaching coil 16*a* likewise decreases. Outdoor ambient air temperature sensor 104*a* senses the outdoor air temperature decrease and, when a first predetermined outdoor air temperature value is reached, energizes valves 104 and 108 to open to allow a portion of the liquid refrigerant to bypass outdoor heat exchanger 20 by flowing directly through auxiliary heat exchanger 24 and to allow a flow of heat exchange fluid to commence through coil 24*a*. The diverted refrigerant flow passes via auxiliary bypass conduit 34*a*, through heat exchanger 24 wherein it absorbs heat from the heat exchange fluid flowing in coil 24*a* and vaporizes, and then via auxiliary bypass conduit 34*b* to conduit 22*e* wherein it mixes with the vaporized refrigerant flow exiting outdoor heat exchanger coil 20*a* via conduit 22*d*. The mixed, vaporized refrigerant flow passes through conduit 22*f* enroute to compressor 12. Temperature sensor 109*a* in indoor heat exchanger 16 senses the temperature of the air after it has been heated by coil 16*a* and operates flow control valve 109 to control the flow of heat exchange fluid reaching coil 24*a* and, thereby, the amount of heat available for transfer to the refrigerant in heat exchanger 24. If desired, optional temperature sensor 106*a*, can energize or de-energize optional solenoid flow control valve 106 in auxiliary bypass conduit 34*a* to control the proportion of liquid refrigerant flow diverted through the auxiliary heat exchanger. In an alternative embodiment, the opening and closing of valves 104 and 108 can be accomplished in response to signals received from temperature sensors 102*a* and/or 102*b* which sense the temperature of refrigerant entering and leaving coil 20*a*, respectively.

In the event the outdoor ambient temperature becomes so low that no meaningful heat transfer between the outdoor ambient air and the liquid refrigerant occurs in outdoor heat exchanger 20, it may become desirable to completely bypass heat exchanger 20 and divert all flow from indoor heat exchanger 16 through auxiliary heat exchanger 24. This can be accomplished by de-energizing and closing solenoid valve 102 in response to a signal from outdoor ambient air temperature sensor 102*c* when a second predetermined outdoor air temperature is reached. Alternatively, the closing of solenoid valve 102 can be accomplished in response to a signal from temperature sensor 102*b* when a predetermined temperature, less than the predetermined temperature for opening valves 104 and 108, is reached. Alternatively, temperature sensors 102*a* and 102*b* can sense the temperature difference between refrigerant inlet and discharge temperatures and de-energize and close solenoid valve 102 when the temperature difference drops to a predetermined value.

If, for some reason, an auxiliary thermal source 26 is unavailable or inadequate or it is uneconomical or undesirable to use such a source, and environmental conditions are such that solar heating is both practical and reliable, then the refrigerant in system 10 may be passed in heat exchange relationship with the solar energy absorbing element of optional solar collector panel 36 to absorb heat directly therefrom. In such a case, flow control valve 112, which is normally open, is partially or completely closed and unevaporated liquid in refrigerant conduit 22*e* is wholly or partially diverted via solar bypass conduit 38*a* through solar collector panel 36, which is suitably located for receiving and absorbing solar radiation. The vaporized refrigerant is then returned via solar bypass conduit 38*b* to refrigerant conduit 22*f* which directs refrigerant flow through reversing valve 14 to compressor 12. A temperature sensor 110*a* in solar bypass conduit 38*b* senses vaporized refrigerant temperature and may be used to energize or de-energize solenoid valve 110 to control refrigerant flow through the panel.

In the cooling mode of operation, heated vaporized refrigerant from compressor 12 is passed via compressor discharge conduit 12*a* through reversing valve 14 positioned as shown in dotted lines to provide cooling from the system and through refrigerant conduits 22*f*, 22*e* and 22*d* to outdoor heat exchanger coil 20*a*. Fan member 20*b* blows outdoor ambient air over coil 20*a*, operating as a condenser coil, and heat is absorbed by the air from the heated vaporized refrigerant in the coil. The vaporized refrigerant in coil 20*a* is condensed by the flow of air thereover and the resulting condensed refrigerant is directed through refrigerant conduit 22*c*, expansion valve 18, open valve 102 and refrigerant conduit 22*b* to indoor heat exchanger coil 16*a*. Fan member 16*b* blows indoor ambient air over the coil 16*a*, operating as an evaporator coil, and heat is absorbed from the ambient air by the liquid refrigerant as the refrigerant vaporizes. The vaporized refrigerant returns to compressor 12 via refrigerant conduit 22*a*, reversing valve 14 positioned as shown in dotted lines to provide cooling from the system and compressor suction conduit 12*b*. In the compressor 12 the vaporized refrigerant is further heated by the work of compression and pump work and the heated vaporized refrigerant is in condition to initiate another cycle of the cooling mode for the heat pump system.

In normal cooling operation, valve 104 is closed and there is no flow of refrigerant through auxiliary heat exchanger 24. However, in cases of extremely high outdoor ambient temperature, where the ability of outdoor heat exchanger 20 to remove heat from the refrigerant is substantially decreased, valve 104 can be opened, a cooling water flow established through coil 24*a* of auxiliary heat exchanger 24 and a portion of the evaporated refrigerant in conduit 22*e* diverted through the auxiliary heat exchanger to condense therein. This serves to relieve the cooling and condensing load on outdoor heat exchanger 20. The condensed liquid refrigerant from auxiliary heat exchanger 24 passes via auxiliary bypass conduit 34*a* and open valve 104 to mix in conduit 22*c* with the condensed refrigerant exiting outdoor heat exchanger 20.

Figure 2:
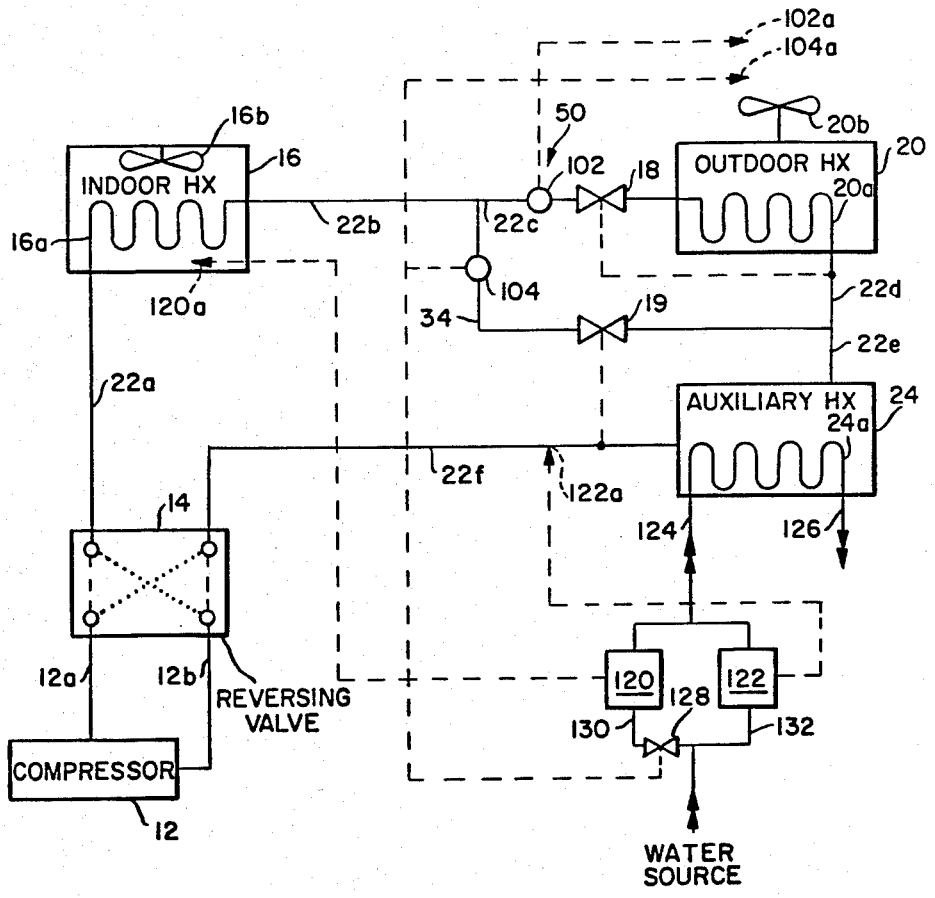
FIG. 2 is a schematic view illustrating a heat pump unit operatively associated with an auxiliary heat exchange coil in accordance with the present invention.

Another form of the heat pump system is illustrated in FIG. 2 and designated system 50. System 50 includes most of the same elements as system 10 but arranges auxiliary heat exchanger 24 in series with outdoor heat exchanger 20 to increase the flexibility of the system to deal with instances of very low or very high outdoor ambient temperatures. In addition, temperature sensing and monitoring means control the flow of a heat exchange fluid to coil 24*a* of the auxiliary heat exchanger in order to most efficiently control heat transfer in the auxiliary heat exchanger. The following brief description of the operation of system 50 in the heating mode will make clear the details of configuration and operation of the system.

In normal operation of system 50 in the heating mode, solenoid valve 102 at the inlet to outdoor heat exchanger 20 is open and solenoid valves 104 and 128 in auxiliary bypass conduit 34 and heat exchange fluid feed line 130 are closed. Heated, vaporized refrigerant is pumped from compressor 12 via compressor discharge conduit 12*a*, reversing valve 14 and conduit 22*a* to indoor heat exchange coil 16*a* wherein the vaporized refrigerant condenses as it gives up its heat to indoor ambient air blown over coil 16*a* by fan member 16*b*. The condensed refrigerant passes via conduit 22*b*, valve 102, expansion valve 18 and conduit 22*c* into coil 20*a* of outdoor heat exchanger 20. Ambient outdoor air blown by fan 20*b* over coil 20*a* gives up its heat to the liquid refrigerant in coil 20*a* to vaporize the refrigerant in the coil. The vaporized refrigerant passes, via conduits 22*d* and 22*e*, to and through auxiliary heat exchanger 24 and then returns to compressor 12 via conduit 22*f*, reversing valve 14 and compressor suction conduit 12*b*. Where the outdoor ambient temperature is above about 35° to 45° F., sufficient heat is absorbed by the refrigerant vaporizing in coil 20*a* to heat the space to be heated when the vaporized refrigerant gives up its absorbed heat to the air blown over coil 16*a* by fan member 16*b*. In such a case, outdoor ambient air temperature sensor 104*a* senses a temperature above a predetermined temperature and valves 104 and 128 remain de-energized and closed. Therefore, there is no bypass flow of refrigerant through auxiliary bypass conduit 34 and expansion valve 19 and no flow of heat exchange fluid, such as water, through coil 24*a*. Accordingly, no heat transfer occurs in auxiliary heat exchanger 24. In such an operating condition, inasmuch as valve 128 is closed, it makes little difference whether water source heating mode flow control valve 120 is open or closed. However, under other operating conditions, where valve 128 is open, flow control valve 120 controls the amount of water reaching coil 24*a* and, therefore, the amount of heat transfer to the refrigerant occurring in auxiliary heat exchanger 24. The position of valve 120 is controlled by temperature sensor 120*a* in indoor heat exchanger 16 which senses the temperature of air after it has been heated by coil 16*a*. When the temperature at 120*a* is below a predetermined minimum, valve 120 opens to allow heat transfer to the refrigerant in auxiliary heat exchanger 24 and, responsive to the temperature sensed at 120*a*, opens more or less to maintain the air temperature at 120*a* as close as possible to the predetermined temperature.

When the outdoor ambient temperature drops below a predetermined temperature, about 35°–45° F., the ability of the outdoor heat exchanger 20 to transfer sufficient heat to the refrigerant decreases and the temperature of the refrigerant sensed by temperature sensor 104*a* likewise decreases. When a temperature below a first predetermined outdoor ambient air temperature is sensed at sensor 104*a*, solenoid valves 104 and 128 are energized to open and a flow or refrigerant is established in auxiliary bypass conduit 34. Thus, of the refrigerant flow passing from indoor heat exchanger 16 to the auxiliary heat exchanger 24 a portion flows, via bypass conduit 34, in parallel to the refrigerant flow in outdoor heat exchanger 20 and a portion flows, through conduits 22*d*, 22*e*, in series with the refrigerant flow in outdoor heat exchanger 20. The division of flow along these two paths is generally determined by the relative positions of expansion valves 18 and 19, which open and close in response to temperatures sensed downstream of outdoor heat exchanger 20 and auxiliary heat exchanger 24, respectively. As a practical matter the predetermined air temperature at 120*a*, about 105° F., is sufficiently high that the temperature sensed at 120*a* is below the predetermined temperature under virtually all conditions where there is no heat transfer to the refrigerant in auxiliary heat exchanger 24. Therefore, valve 120 is generally open and, with valve 128 energized open, a flow of water is established through valve 120 and heat exchange fluid feed lines 130 and 124 to coil 24*a* at a suitable temperature for transferring heat to the refrigerant passing through auxiliary heat exchanger 24. The water is discharged from coil 24*a* via heat exchange fluid discharge line 126. In this way the heat absorbed by the refrigerant in coil 20*a* is supplemented by the heat absorbed by the refrigerant in heat exchanger 24 with the result that liquid refrigerant from bypass conduit 34 and any unvaporized liquid refrigerant exiting coil 20*a* is vaporized in heat exchanger 24 and/or the temperature of the refrigerant vapor, is increased. The heat added to the refrigerant in auxiliary heat exchanger 24 is seen as increased temperature air sensed at 120*a*. In this way, heating mode control valve 120 adjustably passes just sufficient water for heat transfer purposes to raise the air temperature sensed at 120*a* to some predetermined value. Thus, as the outdoor ambient temperature rises and falls, the amount of heat transfer occurring in auxiliary heat exchanger 24 correspondingly decreases and increases.

As the outdoor ambient temperature continues to drop, the amount of heat transferred from the outdoor ambient air to the refrigerant in coil 20*a* likewise continues to decrease until, at some point, the capacity of the outdoor heat exchanger 20 to vaporize refrigerant is low enough that no meaningful heat transfer between the ambient air and the liquid refrigerant occurs in outdoor heat exchanger 20. At this point it becomes desirable to completely bypass heat exchanger 20 and divert all refrigerant flow from indoor heat exchanger 16 through auxiliary heat exchanger 24. This can be accomplished by de-energizing and closing solenoid valve 102 in response to a signal from a temperature sensing means which senses a temperature correlatable to the heat exchange capacity of the outdoor heat exchanger, such as outdoor air temperature sensor 102*a* which signals the closing of valve 102 when the outdoor air temperature drops below a second predetermined value.

It has been found that the system illustrated in FIG. 2 can be most advantageously operated with simultaneous parallel and series refrigerant flow through heat exchangers 20 and 24. By careful adjustment of the system flow control valves maximum efficiency and heat absorption capacity can be realized from the system by cooling the water passing through auxiliary coil 24*a* to 32° F. and utilizing a portion of the latent heat of fusion of the water without flow blockage by ice. This efficiency has been demonstrated in a test system configured as shown in FIG. 2 wherein a space to be heated (not shown) having a volume of 16,200 cubic feet was established in air flow communication with indoor heat exchanger 16. Fan member 16*b* blew indoor ambient air at 68° F. over coil 16*a* at a volumetric flow rate of 2200 cubic feet/minute to produce heated air at 103° F. which was circulated to the space to be heated to maintain the temperature therein at 68° F. The outdoor ambient air temperature was measured to be 10° F. At this low temperature, outdoor heat exchanger 20, which was rated at 36,000 BTU/hour at 17° F., could transfer heat from 10° F. ambient air at a maximum rate of 20,000 BTU/hr. Water was furnished to auxiliary heat exchanger coil 24a at 62° F. at a flow rate of 3½ gallons/minute and was discharged from coil 24a at 32° F. The contribution of compressor heat and motor heat production to the heat absorbed by the refrigerant was estimated to be about 33% of the heat production capacity of the system. Based upon a measured temperature drop of 30° F. through auxiliary heat exchanger coil 24a at a water flow rate of 3½ gallons/minute, assuming no use of latent heat of fusion, the heat transfer rate from coil 24a to the refrigerant was 50,400 BTU/hr. The heat transfer rate to the refrigerant from the outside heat exchanger 20 at 10° F. ambient temperature was 20,000 BTU/hr. Thus, the total heat transfer rate of system 50 to the refrigerant, including compressor and motor heat contribution, was 93,632 BTU/hr. It was noted that the test space to be heated experienced a temperature rise of 2° F. in 140 seconds, indicating it was receiving heat at the rate of 130,000 BTU/hr. Thus, the 36,368 BTU/hr received by the test space from the refrigerant but accounted for in terms of heat transfer to the refrigerant must have been provided to the refrigerant in the proportion 33% from the compressor and 67% from the latent heat of fusion of water. On this basis about 24,367 BTU/hr was obtained from the latent heat of fusion of water, indicating heat extraction therefrom at a rate of about 14.5 BTU/hr/pound of water at 32° F.

In the cooling mode of operation of system 50, heated vaporized refrigerant from compressor 12 is passed via compressor discharge conduit 12a through reversing valve 14 and refrigerant conduit 22f to auxiliary heat exchanger 24. The refrigerant exiting auxiliary heat exchanger 24 via conduits 22e and 22d is directed through coil 20a wherein the refrigerant transfers its heat to and is condensed by the outdoor ambient air blown over coil 20a by fan member 20b. The resulting condensed refrigerant is passed through expansion valve 18, open valve 120, refrigerant conduit 22c, and refrigerant conduit 22b to indoor heat exchanger coil 16a in which the refrigerant is vaporized as it absorbs heat from the indoor ambient air blown over coil 16a by fan member 16b. The vaporized refrigerant returns to compressor 12 via refrigerant conduit 22a, reversing valve 14 and compressor suction conduit 12b. During normal cooling operation, there is no flow of heat exchange fluid through auxiliary heat exchanger coil 24a and, therefore, all heat removal from the refrigerant occurs in coil 20a. However, in cases of extremely high outdoor ambient temperature, where the ability of outdoor heat exchanger 20 to remove heat from the refrigerant is substantially decreased, auxiliary heat exchanger 24 can be utilized to relieve the cooling and condensing load on outdoor heat exchanger 20. In such cases the pressure of the refrigerant vapor sensed by pressure sensor 122a, which is correlatable to refrigerant vapor temperature and, therefore, indicative of the heat content of the vapor, exceeds a predetermined value, e.g., about 225 psi, and a signal from sensor 122a causes cooling mode control valve 122 to open and allow a flow of cooling water through heat exchange fluid feed line 132, valve 122 and heat transfer fluid feed line 124 to coil 24a. The water is discharged from coil 24a via heat transfer fluid discharge line 126. With a flow of cooling water established through coil 24a at least a portion of the vaporized refrigerant passing through auxiliary heat exchanger 24 is cooled and/or condensed prior to entering coil 20a wherein additional heat is removed to completely condense the refrigerant. During normal cooling mode operation, solenoid valve 104 remains closed and there is no flow of refrigerant through auxiliary bypass conduit 34.

In the normal operation of heat pump units as shown in FIG. 2 in the heating mode of operation, when the ambient air temperature is very low, (e.g., less than about 20° C.), there is insufficient thermal energy added to the refrigerant in outdoor heat exchanger 20 and insufficient heat exchange flow through auxiliary heat exchange coil 24a to prevent periodic icing of auxiliary heat exchange coil 24a. The iced coil can be defrosted during the heating mode without need for system shut down or refrigerant flow reversal incident to shifting to a hot gas defrost cycle by modifying the system of FIG. 2 as shown in FIGS. 3–5.

Figure 3:
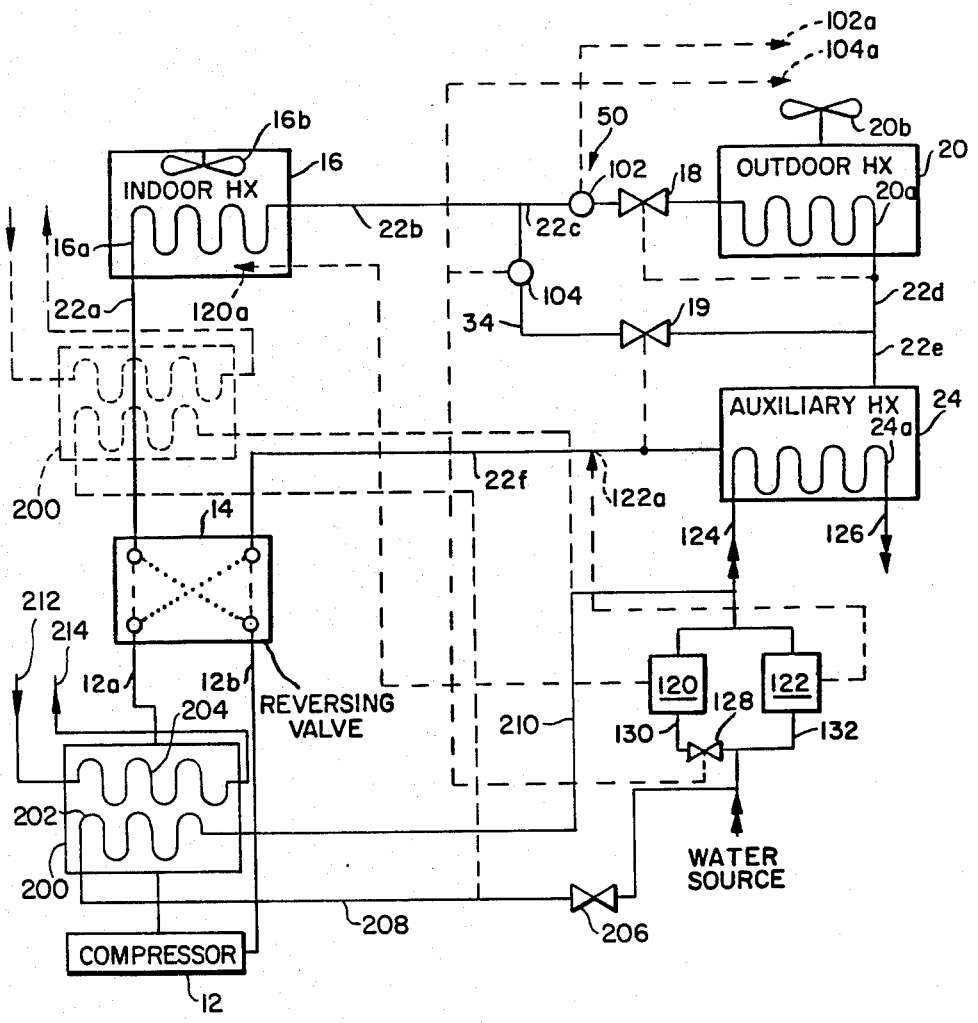
FIG. 3 is a schematic view illustrating a modified form of the heat pump unit shown in FIG. 2 having one form of frost preventative and/or defrost means associated with the auxiliary heat exchange coil thereof.

Referring to FIG. 3 there is shown a heat pump system including an auxiliary coil frost preventative or defrost means consisting essentially of a thermal energy reclamation heat exchanger 200 disposed in the refrigerant line between compressor 12 and indoor heat exchanger 16 and including a first heat exchange coil 202 for heating water from the water source and, optionally, a second heat exchange coil 204 for heating domestic water for use in the structure serviced by the heat pump unit. Desirably, heat exchanger 200 is located in compressor discharge conduit 12a between compressor 12 and reversing valve 14. Alternatively, as shown in phantom in FIG. 3, heat exchanger 200 can be located in conduit 22a between the reversing valve 14 and indoor heat exchanger 16. From the standpoint of defrosting or preventing frost formation on auxiliary heat exchanger coil 24a, it is immaterial whether heat exchanger 200 is located in conduit 12a or 22a. However, from the standpoint of domestic water heating the refrigerant in conduit 12a is always hot, whether the heat pump unit is in the heating or air conditioning mode, allowing domestic water heating to take place at any time. By contrast, the refrigerant in conduit 22a is only hot enough to heat domestic water during the heating mode of heat pump operation.

The defrost or frost preventative capability of the system can be operated harmoniously with normal operation of the system in the heating mode and may either be activated periodically, as by timers, to prevent frost formation or in response to signals from sensors (not shown) which sense, for example, ambient air temperature or refrigerant temperature or pressure in conduit 22d, 22e or 22f. Upon activation of the defrost or frost preventative means with the system in the heating mode of operation a fan limit control in the indoor fan wiring shuts down indoor fan 16b to avoid blowing cold air throughout the space being heated. Water source flow control valve 206, which may be a solenoid operated valve, in water source conduit 208 is opened in response to a signal initiated by a timer, temperature or vapor pressure sensor, to permit water source flow through conduit 208, coil 202 and water source conduit 210 into heat exchange fluid feed line 124 and auxiliary coil 24a. In heat exchanger 200, source water, at about 55° F., is heated by the relatively hot refrigerant gas exiting compressor 12 to about 65° F. The 65° F. water flowing through auxiliary coil 24a rapidly defrosts coil 24a. When defrosting is completed, as determined by a timer control or a refrigerant temperature or pressure sensor, valve 206 is closed to terminate water source flow through heat exchanger 200. Indoor fan 16b is energized to operate only after the refrigerant gas passing through indoor heat exchanger 16 is hot enough to permit an immediate discharge of warm air into the space to be heated. Domestic water may be heated at any time in heat exchanger 200 by thermal exchange with the hot refrigerant gas passing therethrough by flowing domestic water via domestic water feed and return conduits 212, 214 through coil 204.

Figure 4:
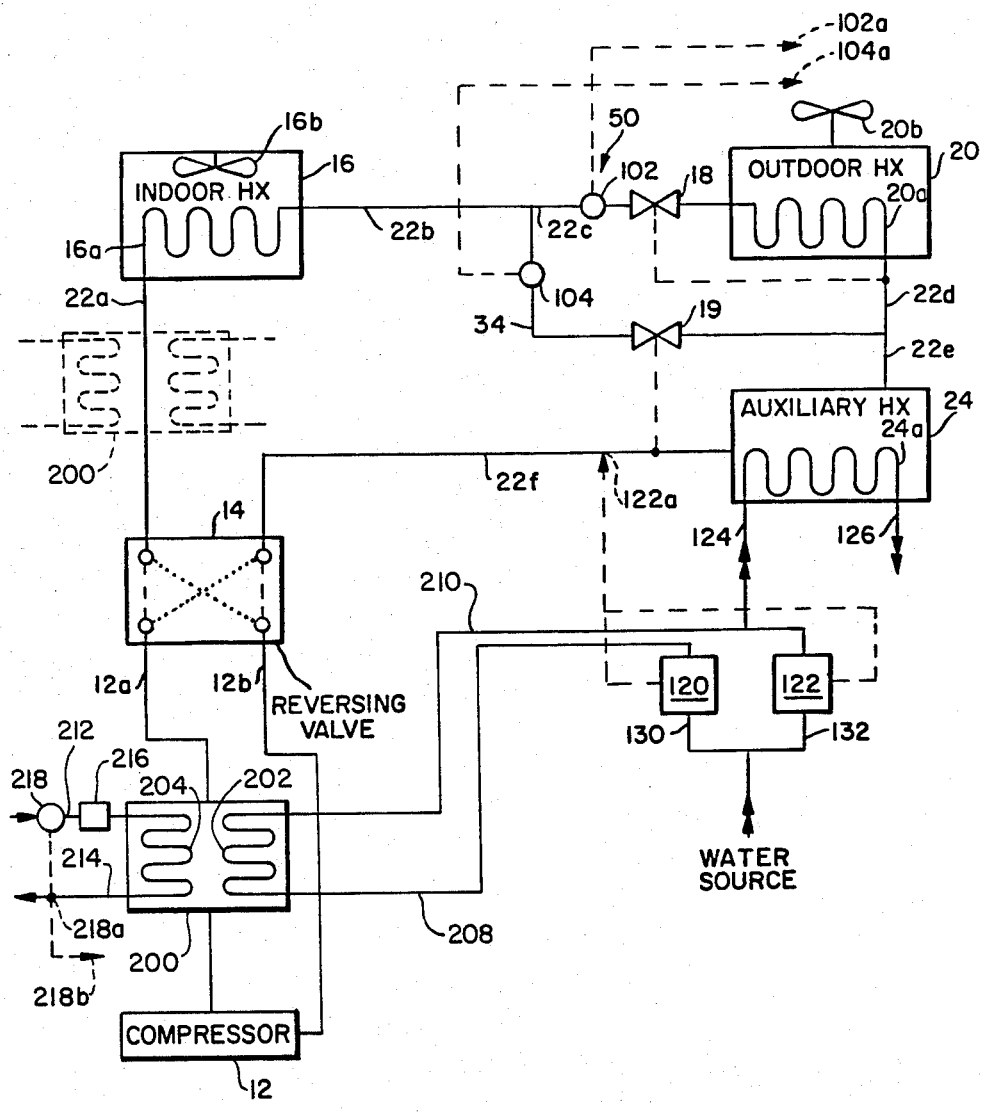
FIG. 4 is a schematic view illustrating a modified form of the heat pump unit shown in FIG. 2 having another form of frost preventative and/or defrost means associated with the auxiliary heat exchange coil thereof.
Figure 5:
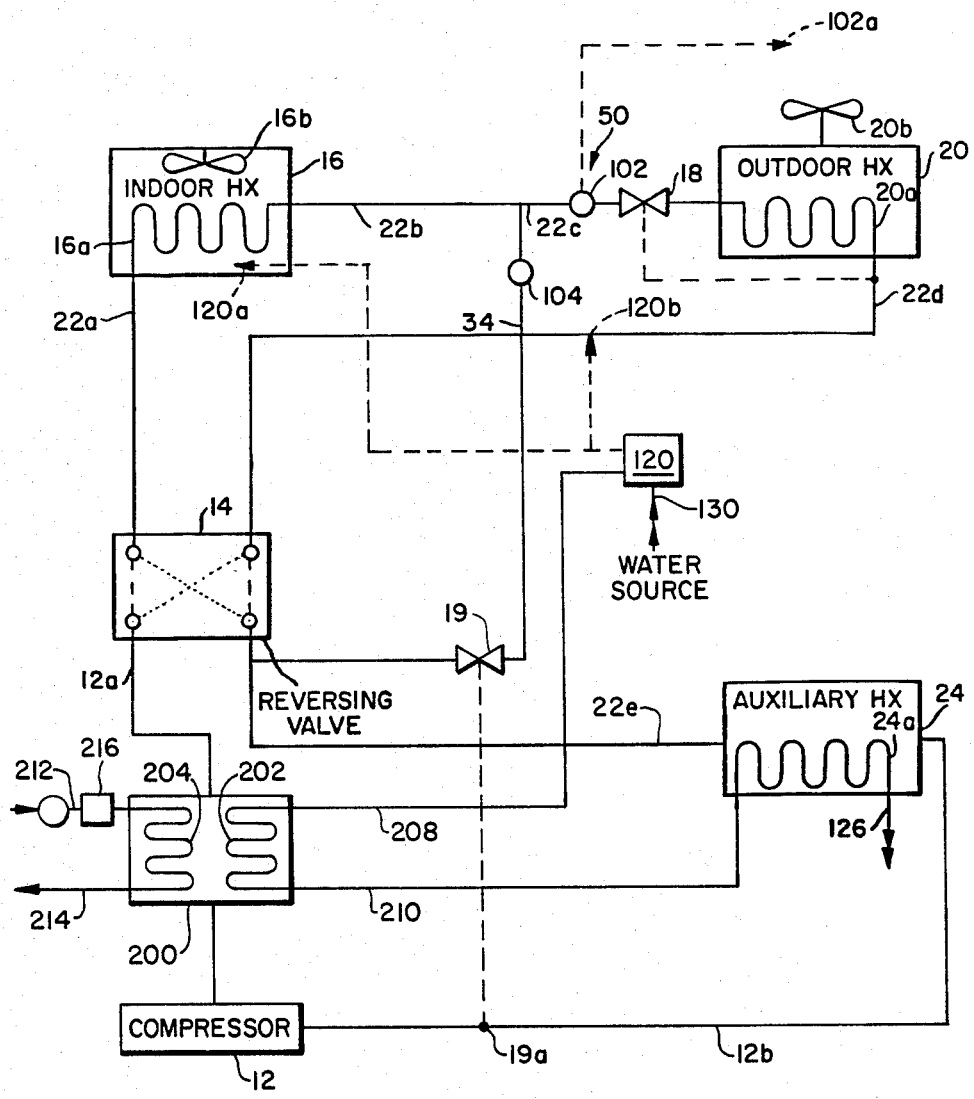
FIG. 5 is a schematic view illustrating a modified form of the heat pump unit shown in FIG. 2 having still another form of frost preventative and/or defrost means associated with the auxiliary heat exchange coil thereof.

In the embodiment of FIG. 4, all heat exchange fluid flow from the water source to auxiliary coil 24*a* passes through reclamation heat exchanger 200, conduit 208, coil 202 and conduit 210. Both flow control valves 120 and 122 preferably operate in response to signals from pressure sensor 122*a* in conduit 22*f*. Pressure responsive valves are preferred for use because of their commercial availability at reasonable cost. Temperature responsive valves, if available, operating in response to a temperature sensor in conduit 22*f* or elsewhere would function equally well. In accordance with this embodiment source water raised to about 65° F. in reclamation heat exchanger 200 is passed through coil 24*a* to transfer thermal energy to refrigerant in the auxiliary heat exchanger 24. As a result icing of the coil is substantially avoided and the higher temperature water, as compared with normally available 55° F. source water, allows a reduction in flow volume from the water source.

As in the FIG. 3 embodiment, heat exchanger 200 is desirably located in compressor discharge conduit 12*a* between compressor 12 and reversing valve 14 in order to allow domestic water heating during both the heating and air conditioning modes of operation. However, heat exchanger 200 can be located in conduit 22*a* if desired, as partially shown in phantom in FIG. 4. Under conditions of extremely low ambient temperatures it may be desirable to reduce the flow rate of domestic water to allow more thermal energy of the refrigerant gas to reach indoor heat exchanger 16. For this purpose, domestic water feed conduit 212 may include an adjustable flow rate pump 216 therein operated in response to thermostat 218 for controlling the flow rate of domestic water into heat exchanger 200 via coil 204. Thermostat 218 may be operated in response to signals received from either ambient air temperature sensor 218*b* or domestic water return temperature sensor 218*a* which senses the temperature of water in domestic water conduit 214. It has been found that a domestic water system heated in this manner can service up to 75% of the hot water needs of an average residence.

Another form of the heat pump system of FIG. 2 including a defrost or frost preventative means is illustrated in FIG. 5. The system shown in FIG. 5 arranges auxiliary heat exchanger 24 in such a manner that it functions as in the FIG. 2 system during the heating mode, with water source feed to the auxiliary coil 24*a* as in the FIG. 4 system, but is outside the flow path for hot, pressurized refrigerant during the air conditioning mode. The following brief description of the operation of the FIG. 5 system in the heating mode will make clear the details of configuration and operation of the system.

In normal operation of the system of FIG. 5 in the heating mode, solenoid valve 102 at the inlet to outdoor heat exchanger 20 is open and solenoid valve 19 in auxiliary bypass conduit 34 is closed. Heated, vaporized refrigerant is pumped from compressor 12 via thermal energy reclamation heat exchanger 200 in compressor discharge conduit 12*a*, reversing valve 14 and conduit 22*a* to indoor heat exchange coil 16*a* wherein the vaporized refrigerant condenses as it gives up its heat to indoor ambient air blown over coil 16*a* by fan member 16*b*. The condensed refrigerant passes via conduit 22*b*, valve 102, expansion valve 18 and conduit 22*c* into coil 20*a* of outdoor heat exchanger 20. Ambient outdoor air blown by fan 20*b* over coil 20*a* give up its heat to the liquid refrigerant in coil 20*a* to vaporize the refrigerant in the coil. The refrigerant passes, via conduit 22*d*, reversing valve 14 and conduit 22*e* to and through auxiliary heat exchanger 24 and then returns to compressor 12 via compressor suction conduit 12*b*. Where the outdoor ambient temperature is above about 35° to 45° F. there is no bypass flow of refrigerant through auxiliary bypass conduit 34 and expansion solenoid valve 19 and no flow of heat exchange fluid, such as water, through coil 24*a*. Accordingly, no heat transfer occurs in auxiliary heat exchanger 24.

Water source flow control valve 120 controls the amount of water reaching coil 24*a* and, therefore, the amount of heat transfer to the refrigerant occurring in auxiliary heat exchanger 24. The position of valve 120 is controlled either by temperature sensor 120*a* in indoor heat exchanger 16 which senses the temperature of air after it has been heated by coil 16*a* or by pressure sensor 120*b* in conduit 22*d* which senses the vapor pressure of the refrigerant gas therein. When the temperature at 120*a* or pressure at 120*b* is below a predetermined minimum, valve 120 opens to allow heat transfer to the refrigerant in auxiliary heat exchanger 24 and, responsive to the temperature sensed at 120*a* or pressure sensed at 120*b* opens more or less to maintain the temperature at 120*a* or pressure at 120*b* as close as possible to the predetermined temperature or pressure.

When the outdoor ambient temperature drops below a predetermined temperature, about 35°-45° F., the ability of the outdoor heat exchanger 20 to transfer sufficient heat to the refrigerant decreases and the temperature sensed at 120*a* or the pressure sensed at 120*b* likewise decreases. A flow of heat exchange fluid commences through valve 120, conduit 208, reclamation heat exchanger coil 202, conduit 210 and auxiliary coil 24*a* for transferring heat to the refrigerant passing through auxiliary heat exchanger 24. The water is heated enroute to coil 24*a* by refrigerant flow through heat exchanger 200 to about 65° F., transfers its heat to the refrigerant in auxiliary heat exchanger 24 and is discharged from coil 24*a* via heat exchange fluid discharge line 126. When a temperature below a first predetermined temperature is sensed at sensor 19*a*, solenoid expansion valve 19 is energized to open and a flow of refrigerant is established in auxiliary bypass conduit 34. Thus, of the refrigerant flow passing from indoor heat exchanger 16 to the auxiliary heat exchanger 24 a portion flows, via bypass conduit 34, in parallel to the refrigerant flow in outdoor heat exchanger 20 and a portion flows, through conduits 22*d*, 22*e*, in series with the refrigerant flow in outdoor heat exchanger 20. The division of flow along these two paths is generally determined by the relative positions of expansion valves 18 and 19, which open and close in response to temperatures sensed downstream of outdoor heat exchanger 20 and auxiliary heat exchanger 24, respectively. In this way, the heat absorbed by the refrigerant in coil 20*a* is supplemented by the heat absorbed by the refrigerant in heat exchanger 24 with the result that liquid refrigerant from bypass conduit 34 and any unvaporized liquid refrigerant exiting coil 20*a* is vaporized in heat exchanger 24 and/or the temperature of the refrigerant vapor, is increased. The heat added to the refrigerant in auxiliary heat exchanger 24 is seen as increased temperature air sensed at 120*a* or increased vapor pressure refrigerant sensed at 120*b*. In this way, water source control valve 120 adjustably passes just sufficient water for heat transfer purposes to raise the air temperature sensed at 120*a* or vapor pressure sensed at 120*b* to some predetermined value. Thus, as the outdoor ambient temperature rises and falls, the amount of heat transfer occurring in auxiliary heat exchanger 24 correspondingly decreases and increases.

As the outdoor ambient temperature continues to drop, the amount of heat transferred from the outdoor ambient air to the refrigerant in coil 20*a* likewise continues to decrease until, at some point, the capacity of the outdoor heat exchanger 20 to vaporize refrigerant is low enough that no meaningful heat transfer between the ambient air and the liquid refrigerant occurs in outdoor heat exchanger 20. At this point it becomes desirable to completely bypass heat exchanger 20 and divert all refrigerant flow directly from indoor heat exchanger 16 through auxiliary heat exchanger 24. This can be accomplished by de-energizing and closing solenoid valve 102 in response to a signal from a temperature sensing means which senses a temperature correlatable to the heat exchange capacity of the outdoor heat exchanger, such as outdoor air temperature sensor 102*a* which signals the closing of valve 102 when the outdoor air temperature drops below a predetermined value.

In the cooling mode of operation of the system of FIG. 5, heated vaporized refrigerant from compressor 12 is passed through heat exchanger 200, via compressor discharge conduit 12*a* through reversing valve 14 and refrigerant conduit 22*d* to coil 20*a* wherein the refrigerant transfers its heat to and is condensed by the outdoor ambient air blown over coil 20*a* by fan member 20*b*. The resulting condensed refrigerant is passed through expansion valve 18, open valve 102, refrigerant conduit 22*c*, and refrigerant conduit 22*b* to indoor heat exchanger coil 16*a* in which the refrigerant is vaporized as it absorbs heat from the indoor ambient air blown over coil 16*a* by fan member 16*b*. The vaporized refrigerant returns to compressor 12 via refrigerant conduit 22*a*, reversing valve 14, auxiliary heat exchanger 24 and compressor suction conduit 12*b*. During normal cooling operation, there is no flow of heat exchange fluid through auxiliary heat exchanger coil 24*a*. Therefore, normally, all heat removal from the refrigerant occurs in coil 20*a*. However, in cases of extremely high outdoor ambient temperature, where the ability of outdoor heat exchanger 20 to remove heat from the refrigerant is substantially decreased, reclamation heat exchanger 200 can be utilized to relieve the cooling and condensing load on outdoor heat exchanger 20. In such cases the domestic water system, consisting of pump 216, conduit 212, coil 204 and conduit 214 carries a flow of cooling water into reclamation heat exchanger 200 to cool the refrigerant gas flowing therethrough. During normal cooling mode operation, solenoid expansion valve 19 remains closed and there is no flow of refrigerant through auxiliary bypass conduit 34.

I claim:

1. A reversible mode heating and cooling system for heating and cooling an interior space, comprising:

(a) compressor means for compressing vaporous refrigerant;

(b) indoor heat exchange means arranged in heat exchange relationship with air in said interior space for condensing refrigerant and heating said air during the heating mode and evaporating refrigerant and cooling said air during the cooling mode;

(c) refrigerant expansion means;

(d) outdoor heat exchange means arranged in heat exchange relationship with outdoor ambient air for evaporating refrigerant during the heating mode and condensing refrigerant during the cooling mode;

(e) refrigerant flow reversing means for providing mode means heating and cooling from the system by refrigerant flow direction selection;

(f) auxiliary heat exchange means for evaporating refrigerant during the heating mode, said auxiliary heat exchange means arranged in a series flow relationship with said outdoor heat exchange means and downstream thereof during the heating mode;

(g) refrigerant conduit means connecting said compressor means, indoor heat exchange means, refrigerant expansion means, outdoor heat exchange means, auxiliary heat exchange means and refrigerant flow reversing means in a series flow relationship to form a reversible heating and cooling system for transferring heat via a fluid refrigerant between said indoor heat exchange means and said outdoor and auxiliary heat exchange means;

(h) bypass refrigerant conduit means connected in a parallel flow relationship with said outdoor heat exchange means and in a series flow relationship with said auxiliary heat exchange means for selectively bypassing said outdoor heat exchange means and directing at least a part of said refrigerant flow through said auxiliary heat exchange means in parallel flow relationship with refrigerant flow through said outdoor heat exchange means;

(i) storage means for storing a heat exchange fluid;

(j) connecting means connecting said storage means and said auxiliary heat exchange means for circulating a heat exchange fluid and exchanging heat between said storage means and said auxiliary heat exchange means, said connecting means including reclamation heat exchange means for transferring heat between said refrigerant and said heat exchange fluid;

(k) first control means for controlling the extent of heat exchange fluid flow from said storage means to said auxiliary heat exchange means, said first control means including a first sensor disposed for sensing a system parameter during the heating mode and first valve means in said connecting means, said first control means including means for adjustably operating said first valve means in said connecting means to allow heat exchange fluid flow therethrough in response to the parameter sensed by said first sensor; and (l) second control means for selectively allowing the flow of refrigerant through said bypass refrigerant conduit means, said second control means including a second sensor disposed for sensing a parameter correlatable to the capacity of said outdoor heat exchanger to add heat to the refrigerant during the heating mode and second valve means in said bypass refrigerant conduit means; said second control means including means for operating said second valve means in said bypass refrigerant conduit means to allow refrigerant flow therethrough in response to the parameter sensed by said second sensor.

2. A system, as claimed in claim 1, wherein said reclamation heat exchange means is disposed in said refrigerant conduit means downstream of said compressor and upstream of said indoor heat exchange means during the heating mode of operation.

3. A system, as claimed in claim 2, wherein said reclamation heat exchange means is disposed in said refrigerant conduit means downstream of said compressor and upstream of said refrigerant flow reversing means.

4. A system, as claimed in claim 3, wherein said connecting means includes conduit means for directing heat exchange fluid flow from said storage means through said reclamation heat exchange means and to said auxiliary heat exchange means.

5. A system, as claimed in claim 4, further including third control means for controlling the heat exchange fluid flow from said storage means to said reclamation heat exchange means in said connecting means.

6. A system, as claimed in claim 4, including fourth control means for terminating refrigerant flow through said outdoor heat exchange means when the heat exchange capacity thereof is reduced below a predetermined level.

7. A system, as claimed in claim 6, wherein said fourth control means comprises a fourth sensing means for sensing a parameter correlatable to the heat exchange capacity of said outdoor heat exchange means and inlet flow valve means disposed upstream of said outdoor heat exchange means and downstream of the flow inlet to said bypass refrigerant conduit means during the heating mode, said fourth control means including means for operating said inlet flow valve means to terminate flow therethrough in response to the parameter sensed by said fourth sensing means.

8. A system, as claimed in claim 7, wherein said fourth sensing means comprises a fourth temperature sensor disposed for sensing the temperature of the outdoor ambient air.

9. A system, as claimed in claim 3, wherein said heat exchange fluid is water.

* * * * *